US010441828B2

(12) United States Patent
Curran et al.

(10) Patent No.: US 10,441,828 B2
(45) Date of Patent: Oct. 15, 2019

(54) POWERED AIR-PURIFYING RESPIRATOR

(71) Applicant: 3M INNOVATIVE PROPERTIES COMPANY, St. Paul, MN (US)

(72) Inventors: Desmond T. Curran, Durham (GB); Andrew Murphy, Spennymoor (GB); Garry J. Walker, Stockton-on-Tees (GB); Terence M. Sayers, Thornley (GB); Christopher P. Henderson, Durham (GB); Bengt Kallman, Leksand (SE)

(73) Assignee: 3M Innovative Properties Company, St. Paul, MN (US)

( * ) Notice: Subject to any disclaimer, the term of this patent is extended or adjusted under 35 U.S.C. 154(b) by 716 days.

(21) Appl. No.: 15/091,145

(22) Filed: Apr. 5, 2016

(65) Prior Publication Data

US 2016/0213955 A1 Jul. 28, 2016

Related U.S. Application Data

(63) Continuation of application No. 13/634,777, filed as application No. PCT/US2011/026963 on Mar. 17, 2010, now abandoned.

(30) Foreign Application Priority Data

Mar. 17, 2010 (GB) ..... 1004405.5

(51) Int. Cl.
*A62B 9/00* (2006.01)
*A62B 18/04* (2006.01)
(Continued)

(52) U.S. Cl.
CPC ..... *A62B 9/006* (2013.01); *A62B 7/10* (2013.01); *A62B 18/045* (2013.01); *A62B 23/02* (2013.01); *A62B 18/006* (2013.01)

(58) Field of Classification Search
CPC .... A62B 7/00; A62B 7/10; A62B 7/12; A62B 9/00; A62B 9/006; A62B 9/04;
(Continued)

(56) References Cited

U.S. PATENT DOCUMENTS 5,392,771 A 2/1995 Mock
5,899,204 A 5/1999 Cochran
(Continued)

FOREIGN PATENT DOCUMENTS

GB 2478759 9/2011
JP 2002-263191 9/2002
(Continued)

*Primary Examiner* — Joseph D. Boecker

(57) ABSTRACT

A powered air purifying respirator (PAPR) for delivering a forced flow of filtered air to a wearer is disclosed. The PAPR comprises a turbo unit with turbo unit components including a fan, an electric motor, and an electronic control unit having a wireless electronic control transceiver, the fan being driven by the electric motor under the control of the electronic control unit and the electronic control unit being configured to send and receive information via the electronic control transceiver; a turbo unit power source that provides power to the turbo unit components; a turbo remote control unit having a wireless turbo remote control transceiver; at least one turbo status indicator unit, adapted to indicate a current operating status of the turbo unit and/or turbo unit components, having a wireless turbo status transceiver; wherein at least one of the turbo remote control unit and turbo status indicator unit is remote from the turbo unit, and wherein at least two of the electronic control transceiver, the turbo remote control transceiver and the turbo status transceiver are in wireless communication with each other.

11 Claims, 3 Drawing Sheets

(51) Int. Cl.
*A62B 23/02* (2006.01)
*A62B 7/10* (2006.01)
*A62B 18/00* (2006.01)

(58) Field of Classification Search
CPC ..... A62B 17/04; A62B 18/00; A62B 18/003; A62B 18/006; A62B 18/04; A62B 18/045; A62B 23/02
See application file for complete search history.

(56) References Cited

U.S. PATENT DOCUMENTS

| | | | | |
|---|---|---|---|---|
| 8,336,553 | B2 | 12/2012 | Bhat | |
| 2002/0155860 | A1 | 10/2002 | Tordera | |
| 2003/0019494 | A1 | 1/2003 | Bennett | |
| 2003/0086433 | A1 | 5/2003 | Tordera | |
| 2003/0190928 | A1 | 10/2003 | Mizumaki et al. | |
| 2005/0217674 | A1 | 10/2005 | Burton | |
| 2006/0125630 | A1 | 6/2006 | Parkulo | |
| 2006/0201509 | A1* | 9/2006 | Forsyth | A62B 7/08 128/204.26 |
| 2007/0050898 | A1 | 3/2007 | Larson | |
| 2007/0132660 | A1* | 6/2007 | Nuttall | G06Q 30/02 345/2.3 |
| 2007/0163588 | A1 | 7/2007 | Hebrank | |
| 2007/0281745 | A1* | 12/2007 | Parkulo | G08B 21/02 455/557 |
| 2008/0023002 | A1 | 1/2008 | Guelzow | |
| 2009/0188501 | A1 | 7/2009 | Forsyth | |
| 2009/0266361 | A1 | 10/2009 | Bilger | |
| 2010/0078017 | A1 | 4/2010 | Andrieux | |
| 2010/0078024 | A1 | 4/2010 | Andrieux | |
| 2010/0108066 | A1 | 5/2010 | Martin | |
| 2010/0108067 | A1 | 5/2010 | Walker | |
| 2010/0153023 | A1* | 6/2010 | Parham | A62B 9/006 702/34 |
| 2010/0195447 | A1* | 8/2010 | George | G04G 13/021 368/13 |
| 2010/0223706 | A1* | 9/2010 | Becker | A42B 3/30 2/8.2 |
| 2013/0092164 | A1 | 4/2013 | Curran | |

FOREIGN PATENT DOCUMENTS

| | | |
|---|---|---|
| JP | 2005-354350 | 12/2005 |
| JP | 2007-293705 | 11/2007 |
| KR | 2004-0100001 | 9/2005 |
| WO | WO 1997/30756 | 8/1997 |
| WO | WO 2009/054856 | 4/2009 |
| WO | WO 2009/067583 | 5/2009 |
| WO | WO 2009/096145 | 8/2009 |

* cited by examiner

POWERED AIR-PURIFYING RESPIRATOR

The present invention relates to a Powered Air Purifying Respirator (PAPR) for delivering a forced flow of filtered air to a wearer.

BACKGROUND

A powered air purifying respirator (PAPR) is a common type of respirator used when working in areas where there is known to be, or there is a risk of there being, dusts, fumes or gases that are potentially hazardous or harmful to health. A PAPR has a turbo unit comprising a fan driven by an electric motor for delivering a forced flow of air to the respirator wearer. One or more filters are fitted to the turbo unit through which air is drawn by the fan. The air is passed from the turbo unit through a breathing tube to a contained wearer environment, such as a face piece, a head piece or a suit, thus providing filtered air to the wearer's breathing zone (the area around their nose and mouth, known as the orinasal area).

A turbo unit for a PAPR may have an electronic control unit to regulate the power driving the fan. Typically, a single power supply, for example a battery pack, provides power for both the fan and the electronic control unit. The electronic control unit may be used to trigger turbo status indicators, for example, to alert the wearer if the airflow falls below a designated level and the designated level of respiratory protection is likely to be compromised. It is also common for the electronic control unit to trigger a status indicator if the battery is depleted to a level where the correct operation of the PAPR is likely to be compromised or to alert the wearer that the filters may be blocked with dust and need to be replaced. Typically turbo status indicators, for example lights and/or buzzers, are mounted on or within the turbo unit housing and arranged to alert the wearer to the current operating status of the turbo unit.

It is usual for the turbo unit to have controls, for example a switch mounted on the turbo unit housing to enable the wearer to turn the turbo unit on and off. Typically, during normal operation of the turbo unit, air should be delivered to the wearer at a predetermined substantially uniform volumetric airflow. The wearer may need to be able to adjust the airflow to a different level, for example if the wearer is working particularly hard and breathing more deeply or at a faster rate than usual, they may desire to increase the airflow. To facilitate this, some turbo units are provided with a control switch on the turbo unit housing to enable the wearer to change the airflow between a discrete range of two, three or more different, pre-set airflow values, for example, 160 liters per minute or 180 liters per minute.

It is common for the turbo unit of PAPRs to be provided with a belt or harness to enable the turbo unit to be secured about the wearer's torso. It is often convenient for the wearer to wear the turbo unit towards the rear of their torso such that it is positioned where it will not interfere with or hinder the work that the wearer is conducting. In these circumstances it may be difficult for the wearer to locate and operate turbo unit controls especially if they out of the range of vision of the wearer. For example, if a turbo unit is provided with an airflow level adjustment as described above, it can be difficult for the wearer to select the correct airflow level if the turbo is out of sight. Furthermore, the wearer may not be able to see visual turbo status indicators that are mounted on the turbo unit. In such situations the wearer relies on hearing an audible indicator and then consults the visual turbo status indicators to diagnose the current operating status of the turbo unit. The above-described situation is often exacerbated by the fact that PAPR wearer containment environments, such as head pieces or masks, can restrict the wearer's peripheral vision thereby limiting the wearer's range of vision.

The use of PAPRs where the wearer containment environment is a full suit has become more popular recently, particularly in emergency response situations. In full suit systems the turbo unit is often enclosed within the suit, such that the wearer does not have access any turbo unit controls. Furthermore, it is often not possible for the wearer to see any turbo unit mounted visual turbo status indicators. Improvements have recently been made to such systems, for example the Chemprotex PRPS (powered respiratory protective suit) system available in the United Kingdom from 3M United Kingdom plc, 3M Centre, Cain Road, Bracknell, RG12 8HT, provides a turbo unit that is modified such that the visual turbo status indicators are located inside the headpiece of the suit in the range of vision of the wearer and connected to the turbo unit via a cable inside the suit.

Such wired solutions as described above provide limited positioning options to suit individual wearer's preference and/or job related preference. The positioning of wired turbo status indicators is often limited to being worn by the PAPR wearer. In many workplace situations, for example working close to rotating machines, the use of wired cables is unlikely to be acceptable due to problem of snagging or entanglement of wires.

It is therefore desirable to be able to use PAPR systems in any type of containment environment whilst giving the wearer easy access to turbo controls and turbo status indicators.

SUMMARY OF THE INVENTION

The present invention aims to address the problems described above by providing a powered air purifying respirator for delivering a forced flow of filtered air to a wearer, comprising: a turbo unit with turbo unit components including a fan, an electric motor, and an electronic control unit having a wireless electronic control transceiver, the fan being driven by the electric motor under the control of the electronic control unit and the electronic control unit being configured to send and receive information via the electronic control transceiver; a turbo unit power source that provides power to the turbo unit components; a turbo remote control unit having a wireless turbo remote control transceiver; at least one turbo status indicator unit, adapted to indicate a current operating status of the turbo unit and/or turbo unit components, having a wireless turbo status transceiver; wherein at least one of the turbo remote control unit or turbo status indicator unit are remote from the turbo unit, and wherein at least two of the electronic control transceiver, the turbo remote control transceiver and the turbo status transceiver are in wireless communication with each other.

By providing a wireless remote control unit and wireless remote status indicator units, improvements in the convenience of PAPRs can be achieved, in particular, the turbo controls are more easily available to a user. By using wireless communication the positioning of the turbo remote control unit and the turbo status indicator unit is fully flexible, offering a considerable improvement over wired systems. This allows the turbo remote control unit and the turbo status indicator unit to be used by a wearer of the turbo or by a colleague positioned remotely from the user. Furthermore, by using the turbo unit power source to power the electronic control transceiver only one battery or other power supply needs to be recharged to ensure that the entire turbo unit is operable.

Preferably, a powered air purifying respirator where the electronic control transceiver, the turbo remote control transceiver and the turbo status transceiver are arranged as a closed loop network.

The wireless communication between the transceivers may be in the range 20 to 50 kHz or the wireless communication may be in the range 100 to 500 THz. Alternatively, the wireless communication between the transceivers may be in the range 0.8 to 6 GHz. In this situation the information may be transmitted in a frequency band centred around 868 MHz, 915 MHz, 2.4 GHz or 5 GHz.

A powered air purifying respirator where the turbo remote control unit and the turbo status indicator unit may be adapted to be used by a wearer of the respirator, or alternatively the turbo remote control unit and the turbo status indicator unit may be adapted to be remote from a wearer of the respirator.

The current operating status of the turbo unit may be indicated by at least one of a visual indicator, an audible indicator and a vibration indicator.

At least one turbo status indicator unit and the turbo remote control unit may be located in a single housing.

The turbo unit further may have a housing in which the turbo unit components are housed, and external data inputs and additional turbo status indicators may be provided thereon.

BRIEF DESCRIPTION OF THE DRAWINGS

By way of example only, an embodiment of the invention will now described below with reference to the accompanying drawings, in which.

DETAILED DESCRIPTION

Figure 1:
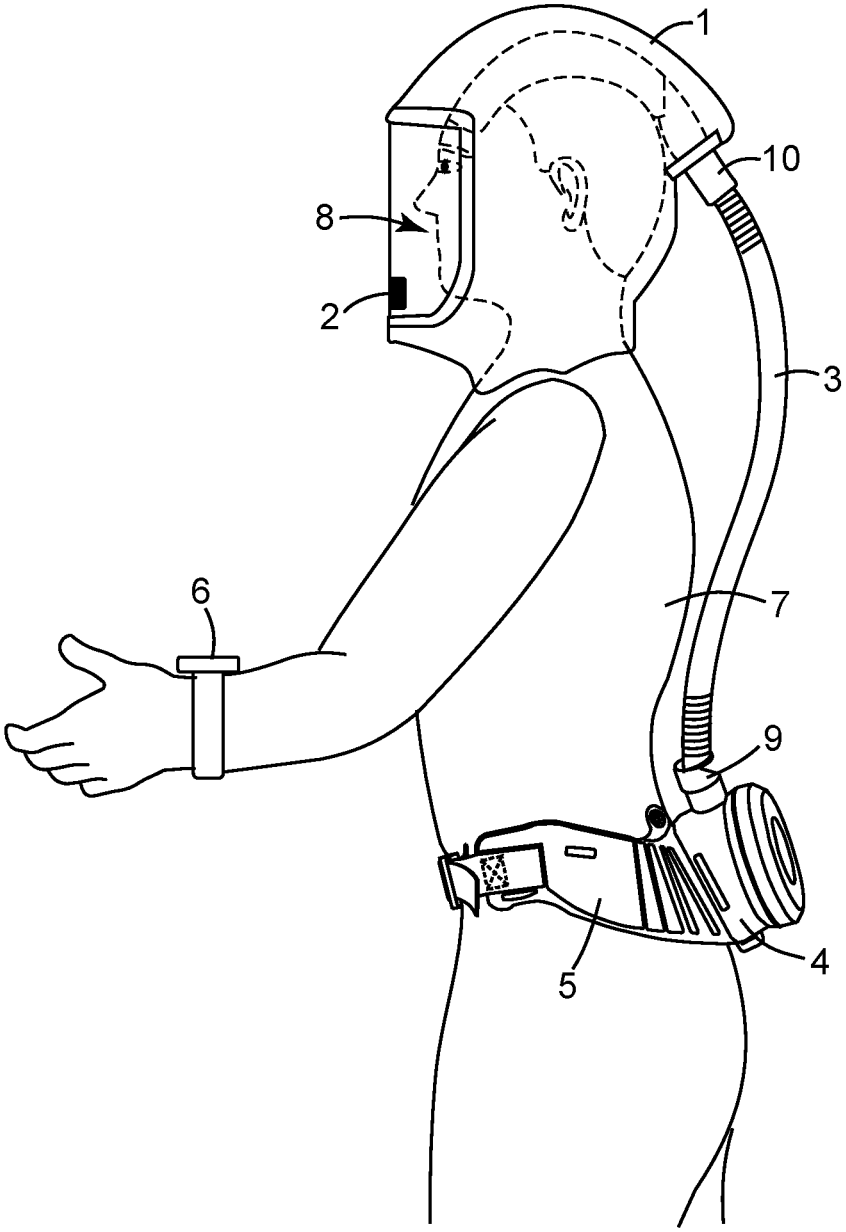
FIG. 1 is a diagrammatic illustration of a powered air purifying respirator (PAPR) according to an embodiment of the present invention.

It has been realised that increased flexibility can be given to the wearers of powered air purifying respirators by taking advantage of wireless technology. Turbo controls and turbo status indicators may be provided in wireless units that can be located either about the wearer's body or remote from the wearer based on the needs of the wearer or the particular job that they are carrying out. Turbo controls, such as on/off switch and airflow adjustment and turbo status indicators, for example, indication of normal operation, low airflow indication, filter change indication, or low battery indication, are common features of PAPRs that can be made more accessible by the present invention.

Wireless technology includes networks such as broadcast networks and closed loop networks. Broadcast communications are wireless systems where a transmitter sends out a signal that is received by any compatible receiver that is within range of the transmitter. A closed loop network in terms of wireless communications is a communication system in which a first transceiver sends a signal, which is preferably encoded, to be received by a designated second transceiver. Usually, the second transceiver returns an acknowledgment signal to the first transceiver before further signals are transmitted. A closed loop network may be made up of many transceivers that are configured to be part of the network. Signals from transceivers that are not configured to be part of the closed loop network are usually ignored, such that wireless communications via closed loop networks can be made secure with reduced susceptibility to external interference.

There are currently three main types of wireless communications that could be used in a PAPR system. Radio frequency (RF) wireless communications, that is, communications systems operating in the frequency range 0.3 to 30 GHz, are particularly suitable for communication systems requiring ranges between 10 to 75 meters. Other forms of wireless communications include communications in the frequency range of 20 to 50 KHz, generally known as ultrasonic (US) communications or communications in the frequency range of 100 to 500 THz, generally known as infrared (IR) communications. Both US and IR communications are suitable for wireless communications over short ranges up to about 2 meters and are particularly suited where line of sight communication is possible. In a PAPR system, it is not always possible to guarantee a clear path between the communication devices, hence RF communications systems where the communication devices do not need to be in line of sight may provide the best flexibility. Other types of wireless communication protocols, suitable for use within a closed-loop network or line of sight may be adapted for use with the present invention.

For clarity of explanation, three units: a turbo unit, a turbo status indicator unit and a turbo remote control unit; and the interactions between the three units will be described below. In the following embodiment the interactions are via a closed loop network using radio frequency communications.

FIG. 1 is a diagrammatic illustration of a powered air purifying respirator (PAPR) according to an embodiment of the present invention. The exemplary PAPR comprises a head or a face piece, such as a hood 1, a turbo status indicator unit 2, a breathing tube 3, a turbo unit 4, a turbo support, such as a belt 5, a turbo remote control unit 6 and a turbo unit power source (not shown). The hood 1 is worn on the wearer's 7 head and at least partially encloses the wearer's head to form a breathing zone 8, that is, the area around their nose and mouth, so that the filtered air is directed to this breathing zone 8. The turbo status indicator unit 2, housing the turbo status indicators, is adapted to fit inside the hood 1 within the range of vision of the wearer 7 and to indicate the current operating status of the turbo unit and/or turbo unit components to the wearer. The range of vision of the wearer includes the range from the top to the bottom of the hood's visor. The turbo unit 4 is attached to a belt 5 to enable it to be secured about the wearer's torso. The turbo unit 4 supplies air to the hood 1 through the breathing tube 3 which is connected between the outlet 9 of the turbo unit 2 and the inlet 10 of the hood 1. The turbo remote control unit 6, housing the turbo controls, may be adapted to be worn about the wearer's wrist and to receive information from the wearer 7. Two or more of the turbo unit 4, the turbo status indicator unit 2 and the turbo remote control unit 6 may be in wireless communication with each other as described below.

In this embodiment, the turbo status indicators and turbo controls are housed in the turbo status indicator unit 2 and the turbo remote control unit 6, respectively, and are remote from the turbo unit 4. It may also be desirable for turbo controls, external data inputs and additional turbo status indicators to be provided on board the turbo unit 4, in addition to those provided in the turbo status indicator unit 2 and the turbo remote control unit 6.

Figure 2:
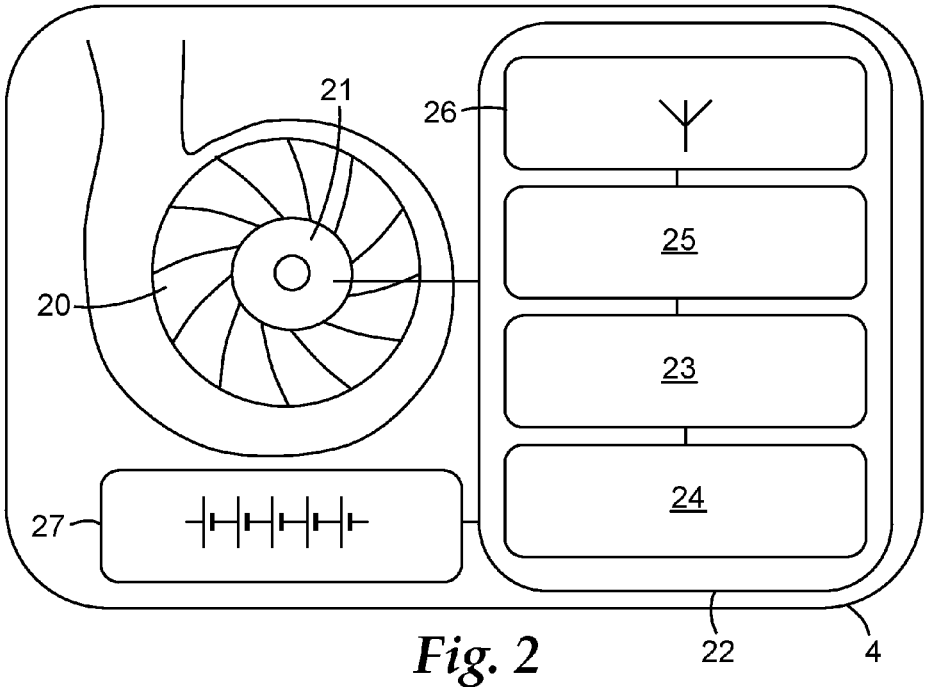
FIG. 2 shows a block diagram of the turbo unit components according to an embodiment of the present invention.

The following illustrates how the turbo unit for a powered air purifying respirator may be arranged. FIG. 2 shows a block diagram of the turbo unit components according to an embodiment of the present invention. The turbo unit 4 comprises turbo unit components including a fan 20, driven by an electric motor 21, and controlled by an electronic control unit 22. The electric motor 21 drives the fan 20, which draws air through the turbo unit 4. The electronic control unit 22, arranged on a printed circuit board or PCB (not shown) also fitted inside the turbo unit 4, includes a microprocessor 23 comprising a single chip microcontroller having an integral memory device 24. The memory device 24 stores a computer program that is executed by the microprocessor 23, and stores information that is used by the microprocessor 23 during the operation of the turbo unit 4. An electronic control transceiver 25 that is a single integrated circuit or module is mounted on the same PCB as the electronic control unit 22. An antenna 26 also part of the PCB, is electrically connected to the electronic control transceiver 25 via the PCB, the antenna being configured to electrically match the resonant frequency band used by the electronic control transceiver 25. A turbo unit power source 27, which is fitted inside the turbo unit 4, provides power to the electric motor 21 and the PCB mounted components, such that only one power source is required to power the complete turbo unit 4, thereby minimising the weight and complexity of the turbo unit. This results in the electronic control unit 22 being configured to communicate with, send information to and receive information from, the turbo remote control unit 6 and the turbo status indicator unit(s) 2 via the electronic control transceiver 25 and the antenna 26.

Figure 3:
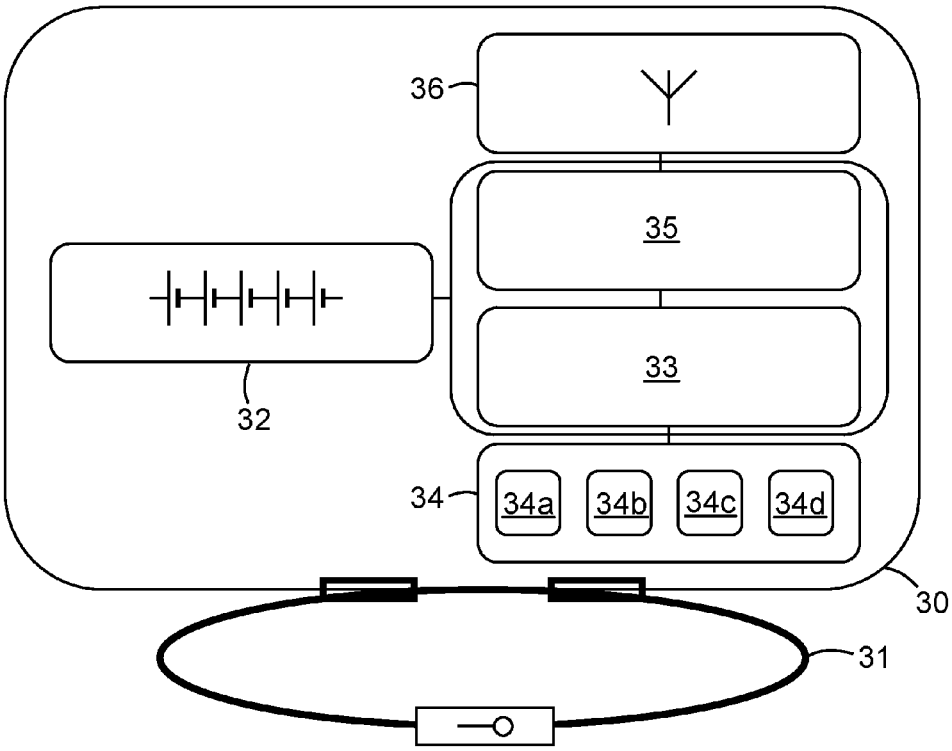
FIG. 3 shows a block diagram of a turbo remote control unit according to an embodiment of the present invention.

FIG. 3 shows a block diagram of a turbo remote control unit according to an embodiment of the present invention. In this embodiment the turbo remote control unit 6 comprises a housing 30 attached to a wrist strap 31 to enable it to be worn around the wrist. This may be achieved by threading the wrist strap 31 through a series of moulded plastic loops formed on the exterior of the housing 30. A power source 32 is provided within the housing and is in electrical connection with a microprocessor 33, mounted on a printed circuit board or PCB (not shown) also provided within the housing 30. Four switches 34*a*, 34*b*, 34*c*, 34*d*, adapted to provide external data inputs, are positioned on the exterior of the housing 30 so as to be accessed easily by the wearer of the turbo remote control unit 6. A turbo remote control transceiver 35 and an antenna 36 are also provided to facilitate wireless communication with the turbo unit 4 and/or the turbo status indicator unit 2, and are mounted on the same PCB as the microprocessor 33. This allows the remote control transceiver 35 and antenna 36 to be powered by the same power source 32 as the microprocessor 33, removing the need for any additional power sources, and therefore weight, to be placed within the housing 30. The microprocessor 33 comprises a single chip microcontroller with integral memory, which contains a computer program that is executed by the microprocessor 33 and is necessary for the functioning of the turbo remote control unit 6. Similar to the turbo unit antenna 26, the turbo remote control unit antenna 36 is configured to electrically match the resonant frequency band of the wireless communications used by the electronic control transceiver 25. This results in the turbo remote control unit 6 being configured to communicate with, send information to and receive information from, the turbo unit 4 and the turbo status indicator unit 2 via the turbo remote control transceiver 35 and the antenna 36.

The plurality of switches 34*a, b, c, d* are provided to enable the wearer 7 to input turbo control information or external data into the turbo remote control unit 6. These external data inputs or turbo controls include turbo start and stop switches 34*a*, 34*b*, and airflow adjustment switches 34*c*, 34*d*, to increase and decrease airflow. The switches 34 are membrane switches, mounted on an exposed surface of the housing 30 so they can be operated by the wearer 7, and are connected to the microprocessor 33 via suitable wires and connectors (not shown). The switches 34*a, b, c, d* are identified with suitable indicia to indicate the function that they perform to the wearer 7. The information inputted into the turbo remote control unit 6 by means of the switches 34*a, b, c, d* is processed by the microprocessor 33 prior to being transmitted by the turbo remote control transceiver 35 to the turbo unit's electronic control unit 22 via the turbo remote control transceiver 35, the electronic control transceiver 25 and antennas 26, 36. The turbo electronic control unit 22 processes the information received and adjusts the current operation of the turbo unit 4 accordingly.

Although in the present embodiment the external data inputs or switches 34*a, b, c, d* of the turbo remote control unit 6 are membrane switches, rotary, push button, toggle or other types of switches may be used. It is desirable that the switches 34*a, b, c, d* may not be inadvertently operated, for example accidentally switching off the turbo unit. To safe guard against such an occurrence, a delay may be incorporated with the operation of the switch such that the switch has to be depressed for several seconds before a switch action is recognised by the microprocessor 33. Furthermore, the external data inputs may be manual data inputs, such as the switches 34*a, b, c, d* described above, or they may be configured as an interface for connection to a remote device, for example a gas sensor, a laptop or a personal data assistant.

Figure 4:
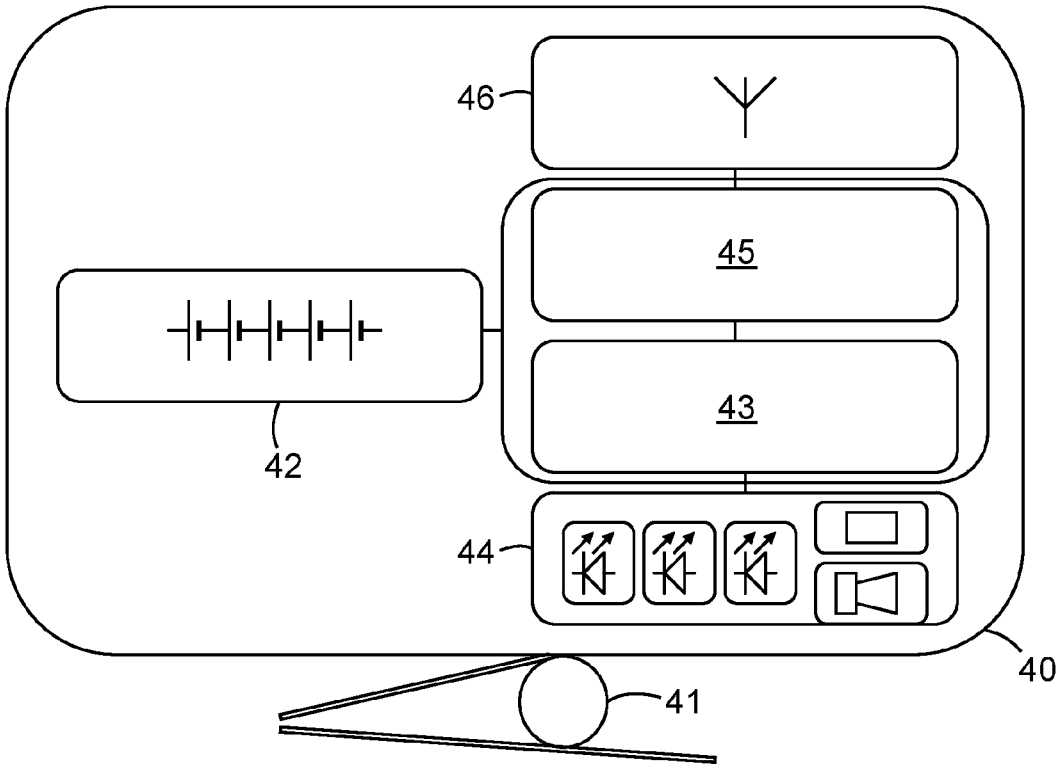
FIG. 4 shows a block diagram of a turbo status indicator unit according to an embodiment of the present invention.

FIG. 4 shows a block diagram of a turbo status indicator unit according to an embodiment of the present invention. In this embodiment the turbo status indicator unit 2 comprises a housing 40 fitted with an attachment clip 41 to enable the turbo status indicator unit 2 to be removably fitted inside the hood 1 within the range of vision of the wearer 7. The attachment clip 41 is a metal spring clip secured to the housing 40 by means of a screw and arranged to clip on to a flap of material (not shown) sewn into the hood 1. The flap of material is suitably located to accept the attachment clip 41 so that the indicator unit is within the range of vision of the wearer 7. A power source 42 is provided within the housing 40 and is in electrical connection with a microprocessor 43 that is mounted on a printed circuit board or PCB (not shown) also provided within the housing. The turbo status indicator unit 2 is provided with a set of the turbo status indicators 44 comprising; three visual indicators; an audible indicator and a vibration indicator. The visual indicators are located on an external surface of the housing and positioned to be in the range of vision of the wearer when the turbo status indicator unit is clipped inside the hood 1. The audible indicator is located within the housing adjacent to a plurality of holes in the housing, such that sound from the audible indicator can be heard by the wearer 7. The vibration indicator is also located inside the housing, such that when the vibration indicator is activated it causes the complete housing to vibrate to draw the wearer's attention to the visual indicators. The turbo status indicators 44 are electrically connected to the PCB and the microprocessor 43 by means of flexible wires (not shown). A turbo status transceiver 45 and an antenna 46 are also provided to facilitate wireless communications with the turbo unit 4 and/or the turbo remote control unit, and are mounted on the same PCB as the microprocessor 43. This allows the power source 42 to provide power to the microprocessor 43, the turbo status indicators 44, the turbo status transceiver 45 and the antenna 46. The microprocessor 43 comprises a single chip microcontroller with integral memory, which contains a computer program that is executed by the microprocessor 43 and is necessary for the functioning of the turbo status indicator 2. Similar to the turbo unit antenna 26, the turbo status indicator unit antenna 46 is configured to electrically match the resonant frequency band of the wireless communication network used by the electronic control transceiver 25. This results in the turbo status indicator unit 2 being configured to communicate with, send information to and receive information from, the turbo unit electronic control unit 22 and the turbo remote control unit 6 via the turbo status transceiver 45 and the antenna 46.

During the operation of the turbo unit 4, the electronic control unit 22 samples information from the electric motor 21 and turbo unit components, for example motor speed, motor voltage, and battery voltage, to determine the current operating status of the turbo unit 4. If the turbo unit 4 is operating within pre-defined parameters the current operating status is deemed normal operation. The turbo unit 4 transmits information via the wireless communications network to the turbo status indicator unit 2 to indicate this normal operation to the wearer 7 via the plurality of turbo status indicators 44. If for example, the airflow falls below a designated level, the electronic control unit 22 will trigger a low-airflow status indicator and information transmitted to the turbo status indicator unit 2 indicates a low-airflow status to the wearer 7 via the turbo status indicators 44. Likewise, as the power source 27 is depleted during the operation of the turbo unit 4, the electronic control unit 22 will trigger a battery status indicator, which again is communicated to the wearer 7 via the turbo status indicators 44. The turbo status indicators 44 are updated at regular intervals to indicate the current operating status of the turbo unit 4. In the exemplary embodiment these updates occur every 10 seconds.

The plurality of indicators 44 of the turbo status indicator unit 2 includes at least a visual indicator, and may also include at least an audible indicator and/or a vibration indicator. The visual indicator is a light emitting diode (LED) that is visible external to the turbo status indicator. Other light sources such as a bulb may be suitable. However, the visual indicator may be an alternative type of indicator, for example: a visual display such as a liquid crystal display (LCD) may be adapted to provide a warning message or a numeric display. Illumination provided by the visual indicator may be continuous, intermittent, or display information to the wearer. For example, if the visual indicator comprises a light, the light may be flashed intermittently to attract the attention of the wearer 7. The visual indicators are mounted inside or on the housing of the turbo status indicator unit 2 such that they can be seen from the outside of the unit. Where visual indicators are mounted inside the turbo status indicator unit 2, the housing 40 may be constructed from a transparent or partially transparent plastic material whereby the indicator can be seen through the housing wall or a suitably located transparent window. Alternatively, visual indicators may be arranged such that they are mounted on the PCB inside the turbo status indicator unit 2 and protrude through the housing 40 such that they can be seen from the outside of the unit 2. In order to be effective the turbo status indicator unit 2 is positioned such that the visible indicator is in the range of vision of the wearer 7.

The audible indicator is preferably given by a piezoelectric device, although alternative types of sounders or buzzers may be used, for example, electro-mechanical buzzers. The audible indicator may be continuous or intermittent, or may be variable in volume and/or in the frequency of the sound produced. To be effective, where the turbo status indicator unit 2 comprises an audible indicator, the turbo status indicator unit 2 is positioned such that the audible indicator is positioned where it can be heard by the wearer 7. It may be necessary for the housing to be provided with a suitable means for the sound from the audible indicator to be transmitted to the outside of the housing. For example, this may be achieved by a plurality of holes in the housing 40 or by the use of a sound transmitting membrane or medium.

For certain applications, such as noisy environments where it may be difficult for the wearer 7 to hear an audible indicator, it may be desirable to use a vibration indicator such as those commonly found in mobile phones. The vibration indicator may be set to vibrate continuously or intermittently. The vibration indicator may be mounted inside the housing 40 such that either all or part of the housing is caused to vibrate when the vibration indicator is triggered. Where the turbo status indicator unit 2 comprises a vibration indicator the turbo status indicator unit 2 is positioned such that the vibration indicator can be sensed by the wearer 7.

Each type of status indicator 44 may be used alone or in combination with one or more other types of indicator. For example, it may be desirable to operate an intermittent visual indicator and an intermittent audible indicator simultaneously, ensuring that the flashing of the visual indicator occurs contemporaneously with the sounding of the audible indicator. Another exemplary combination may be the use of an audible and a vibration indicator simultaneously.

In an exemplary embodiment the turbo status indicator unit 2 is provided with a visual indicator, an audible indicator and a vibration indicator in or on the same housing 40. However it may be more convenient to provide these as separate turbo status indicators units. For example, a visual indicator and an audible indicator may be provided in a turbo status indicator unit 2 located in the hood 1 of a PAPR and positioned so they can be seen and heard by the wearer 7 and a vibration indicator may be provide in a turbo status indicator unit 2 secured to the wearer's wrist by a wrist strap so the vibration can be sensed by the wearer 7. Furthermore, it may be convenient for a vibration indicator to be located in the wrist strap 31 of the turbo remote control unit 6. Alternative combinations of any of the three status indicator types and different locations on the wearer's body, for example ankle, wrist, torso or leg are envisaged.

The turbo remote control unit 6 of the embodiment is fitted with a wrist strap 31 such that it may be worn on the wearer's 7 wrist and the turbo status indicator unit 2 is fitted with an attachment clip 41 such that it may be fitted inside the hood 1. It is envisaged that both units may have alternative mounting or attachment means to enable them to be worn or positioned in a suitable location depending on the wearer's 7 preference or requirements, and/or the nature of the work that they are carrying out. Examples of alternative mounting or attachment means include a shirt or collar clip, a belt loop and hook and loop fastenings. Furthermore, it may be desired that the turbo remote control unit 6 and turbo status indicator units 2 do not have any attachment means, where the units 2, 6 may be carried in a pocket or placed in the wearer's work environment. In some work situations it may be preferable for the turbo remote control unit 6 and the turbo status indicator unit 2 to be located remote from the wearer 7, for example they may be worn or monitored by a colleague such as a co-worker, supervisor, or safety officer.

Furthermore, it may be desired that the turbo status indicator unit 2 and the turbo remote control unit 6 are located in a single housing. In this configuration, the turbo controls and the turbo status indicators are connected to the same microprocessor and communicate with the turbo electronic control transceiver 25 via a single transceiver and antenna system controlled by the microprocessor.

The turbo unit 4, the turbo remote control unit 6 and the turbo status indicator unit 2 housings are preferably made from a light weight strong material, for example injection moulded from a thermo-plastic material. Injection moulding allows the housings to be formed in a suitable shape to house the particular component parts. A wide range of materials are available and can be chosen to withstand the environment in which the PAPR is intended to be used. Where the antennas 26, 36, 46, of the turbo unit 4, the turbo remote control unit 6 and the turbo status indicator unit 2 are located within their respective housings, the housing material is chosen to be transparent to the wireless communications such that the wireless communications are not adversely affected by the housing materials.

The power source 27 for the turbo unit 4 shown in FIG. 2 is a battery pack fitted inside the turbo unit 4. Preferably the battery pack 27 is constructed from rechargeable cells that can be recharged by means of a suitable battery charger prior to a work period. The battery pack 27 may be removable from the turbo unit housing and have suitable connectors such that it can be fitted and removed easily. The turbo unit 4 may be provided with a charging socket (not shown) to enable a suitable battery charger to be connected to the turbo unit 4 to recharge the battery pack 27 without removing it from the turbo unit 4. The battery pack 27 may also be provided with a charge socket (not shown) so that the battery pack 27 may be recharged whilst disconnected from the turbo unit 4. Commonly available secondary cells, that are rechargeable cells, for example nickel metal hydride (NiMH) or lithium ion (Li-ion) cells may be suitable for powering the electric motor 21 and have sufficient power capacity to also provide power for the electronic control transceiver 25. Alternatively, primary cells, that are dry cells, may be used and be replaced when their power has been depleted.

In an alternative configuration, the battery pack 27 may be external to the turbo unit 4 and connected to the turbo unit 4 via a suitable cable. In this situation, the battery pack may be provided in a separate housing, for example a housing with belt loops such that it could be worn on the same belt 5 that is used to support the turbo unit 4, such that weight can be distributed around the wearer's 7 waist.

The turbo status indicator unit 2 power source 42 and the turbo remote control unit 6 power sources 32 may also be battery packs fitted inside their respective housings 40, 30, with suitable connectors to allow them to be fitted and removed/replaced as necessary. These battery packs 32, 42 may also be constructed from either rechargeable or dry cells similar to those used to power the turbo unit 4. Where a rechargeable battery pack is used, the unit 2, 6 may be provided with a charging socket (not shown) to enable a suitable battery charger to be connected to the unit 2, 6 to recharge the battery pack 32, 42 without removing it from the unit 2, 6. The battery packs 32, 42 may be fitted with charging sockets (not shown) to allow them to be recharged outside of the units. It may be convenient for the turbo status indicator unit 2 and the turbo remote control unit 6 to use identical battery packs that are interchangeable if necessary.

All of the units, that is the turbo unit 4, the turbo status indicator unit 2 and the turbo remote control unit 6 may have an indicator fitted to them to indicate to the wearer 7 how much charge is remaining in the fitted battery pack. Furthermore, the battery packs themselves may have a battery status indicator fitted to them.

The microprocessors 23, 33, 43, of the exemplary embodiment are single chip microcontrollers with integral memory. For example, a suitable microcontroller may be from the PIC18F25J11 family available from Microchip Technology Inc, 2355 West Chandler Blvd, Chandler, Ariz., USA 85224-6199. Alternatively the microprocessors may be a general purpose microprocessor, for example, from the megaAVR™ or XMEGA™ series of microprocessors from Amtel Corporation 2325 Orchard Parkway, San Jose, Calif., USA, 95131. The microprocessor may have integral memory such as flash RAM or alternatively the microprocessor may be connected to and in communication with a separate memory device such as an EPROM or an EEPROM device.

In the exemplary PAPR, the wireless communications is by means of radio frequency (RF) communications in a frequency band centred around one of 868 MHz (865-870 MHz) in Europe, 915 Mhz (902-928 MHz) in USA and Australia or 2.45 GHz (2.4-2.5 GHz) and 5.8 GHz (5.725-5.875 GHz) in most other worldwide jurisdictions. The protocol and technology known generally under the trade name of "Zigbee®", standardised by the Zigbee Alliance, may be used for this application as the protocol can form secure closed loop networks and low power consumption of transceivers based on "Zigbee®" technology gives rise to long battery life. The maximum distance over which wireless communications using "Zigbee®" protocol can be reliably maintained is in the range of 10 to 75 meter which is ideally suited to PAPR application. The "Zigbee®" protocol can be configured to form a closed loop network wirelessly connecting many "Zigbee®" protocol enabled devices.

A suitable transceiver circuit that can use the "Zigbee®" wireless communications protocol described above is the MRF24J40MA transceiver module available from Microchip Technology Inc, 2355 West Chandler Blvd, Chandler, Ariz., USA 85224-6199. This integrated circuit has an integral printed circuit board (PCB) antenna and an interface for direct connection to a microprocessor or microcontroller. A transceiver would need to be provided in each of the units in a PAPR, for example in the turbo unit 4, the turbo status indicator unit 2 and the turbo remote control unit 6.

In the exemplary embodiment the electronic control transceiver 25, turbo status transceiver 45 and the turbo remote control transceiver 35 are single integrated circuits or modules. Alternatively the above transceivers 35, 45 may be bespoke designed transceivers comprising a plurality of discrete electronic components arranged on a PCB. Frequency bands other than those listed about may be used depending on the regulations in the jurisdiction in which the PAPR is intended to be used.

Although the protocol and technology under the "Zigbee®" trade name is described in the above exemplary PAPR, other RF wireless communications may be used such as an alternative standardised protocol, for example communications protocols known generally under the trade names of "Bluetooth®" and "MiWi™", or a bespoke system and protocol could be developed. Some wireless systems are available as single chip devices or as complete modules provided on printed circuit boards or ceramic substrates. Such modules often have antennas build into them, for example a PCB antenna or a chip antenna. Where antennas are not integrated into the device or module, it is necessary to provide a suitable antenna, for example a helical or wire antenna that is capable of operating at the working frequency of the transceiver. The antenna may be provided internally to the turbo status indicator unit 2, turbo remote control unit 6 and/or turbo unit 4, or alternatively the antenna may be located externally to the units 2, 4, 6.

Although a hood 1 is illustrated in FIG. 1, the hood 1 could substituted by another head or face piece, such as a mask, a helmet or a full suit, provided that a wearer containment environment, covering at least the orinasal area of the wearer's face, to direct air to the wearer's breathing zone 8, is created.

The invention claimed is:

1. A powered air purifying respirator for delivering a forced flow of filtered air to a wearer, comprising:

a turbo unit with turbo unit components including a fan, an electric motor, and an electronic control unit having a wireless electronic control transceiver, the fan being driven by the electric motor under control of the electronic control unit and the electronic control unit being configured to send and receive information via the electronic control transceiver;

a turbo unit power source that provides power to the turbo unit components;

a turbo remote control unit having a wireless turbo remote control transceiver;

at least one turbo status indicator unit, adapted to indicate a current operating status of the turbo unit and/or turbo unit components, having a wireless turbo status transceiver;

wherein at least one of the turbo remote control unit and turbo status indicator unit is remote from the turbo unit, and wherein wireless communication occurs between at least two of the electronic control transceiver, the turbo remote control transceiver and the turbo status transceiver.

2. A powered air purifying respirator according to claim 1, wherein the electronic control transceiver, the turbo remote control transceiver and the turbo status transceiver are arranged as a closed loop network.

3. A powered air purifying respirator according to claim 1, wherein wireless communication between the transceivers is in the range 20 to 50 kHz.

4. A powered air purifying respirator according to claim 1, wherein wireless communication between the transceivers is in the range 100 to 500 THz.

5. A powered air purifying respirator according to claim 1, wherein wireless communication between the transceivers is in the range 0.3 to 10 GHz.

6. A powered air purifying respirator according to claim 5, wherein information is transmitted in a frequency band centred around 868 MHz, 915 MHz, 2.45 GHz or 5.8 GHz.

7. A powered air purifying respirator according to claim 1, wherein the turbo remote control unit and the turbo status indicator unit are adapted to be used by a wearer of the powered air purifying respirator.

8. A powered air purifying respirator according to claim 6, wherein the turbo remote control unit and the turbo status indicator unit are adapted to be remote from a wearer of the powered air purifying respirator.

9. A powered air purifying respirator according to claim 1, wherein the current operating status of the turbo unit is indicated by at least one of a visual indicator, an audible indicator and a vibration indicator.

10. A powered air purifying respirator according claim 1, wherein at least one turbo status indicator unit and the turbo remote control unit are located in a single housing.

11. A powered air purifying respirator according claim 1, wherein the turbo unit further comprises a housing in which the turbo unit components are housed, having external data inputs and one or more additional turbo status indicators provided thereon.

* * * * *